US010487992B2

(12) United States Patent
West

(10) Patent No.: US 10,487,992 B2
(45) Date of Patent: Nov. 26, 2019

(54) LED-BASED LINEAR LAMPS AND LIGHTING ARRANGEMENTS

(71) Applicant: Intematix Corporation, Fremont, CA (US)

(72) Inventor: Scott West, Fremont, CA (US)

(73) Assignee: Intematix Corporation, Fremont, CA (US)

( * ) Notice: Subject to any disclaimer, the term of this patent is extended or adjusted under 35 U.S.C. 154(b) by 0 days.

(21) Appl. No.: 15/958,416

(22) Filed: Apr. 20, 2018

(65) Prior Publication Data

US 2018/0306388 A1 Oct. 25, 2018

Related U.S. Application Data

(60) Provisional application No. 62/482,516, filed on Apr. 6, 2017.

(51) Int. Cl.

| | |
|---|---|
| ***F21V 21/00*** | (2006.01) |
| ***F21K 9/64*** | (2016.01) |
| ***F21S 8/04*** | (2006.01) |
| ***F21V 9/32*** | (2018.01) |
| ***F21V 5/10*** | (2018.01) |
| ***F21K 9/275*** | (2016.01) |
| ***F21V 9/30*** | (2018.01) |
| ***F21V 9/08*** | (2018.01) |
| ***F21V 13/08*** | (2006.01) |
| ***F21V 19/00*** | (2006.01) |
| *F21Y 103/10* | (2016.01) |
| *F21Y 115/10* | (2016.01) |

(52) U.S. Cl.

CPC ..... *F21K 9/64* (2016.08); *F21K 9/275* (2016.08); *F21S 8/04* (2013.01); *F21V 5/10* (2018.02); *F21V 9/08* (2013.01); *F21V 9/30* (2018.02); *F21V 9/32* (2018.02); *F21V 13/08* (2013.01); *F21V 19/003* (2013.01); *F21Y 2103/10* (2016.08); *F21Y 2115/10* (2016.08)

(58) Field of Classification Search

CPC ..... F21K 9/64; F21V 5/10; F21V 9/30; F21V 9/32; F21V 9/08

USPC ..... 362/84

See application file for complete search history.

(56) References Cited

U.S. PATENT DOCUMENTS

2012/0176768 A1* 7/2012 Wu ..... F21K 9/27 362/84
2012/0275150 A1* 11/2012 Yokotani ..... F21V 5/007 362/235
2013/0286632 A1* 10/2013 Edwards ..... H01L 33/502 362/84
2013/0293098 A1* 11/2013 Li ..... F21V 3/02 313/512
2014/0218892 A1* 8/2014 Edwards ..... F21K 9/232 362/84

(Continued)

FOREIGN PATENT DOCUMENTS

DE 102012102122 A1 9/2013
EP 2518395 A2 10/2012

*Primary Examiner* — Laura K Tso

(57) ABSTRACT

There is provided an elongated optical component having a direction of elongation, comprising: a light transmissive core and a wavelength converting portion disposed on an exterior surface of the light transmissive core, wherein the wavelength converting portion comprises a photoluminescence material, and wherein the wavelength converting portion has a cross-section comprising an apex.

17 Claims, 9 Drawing Sheets

(56) References Cited

U.S. PATENT DOCUMENTS

| | | | | |
|---|---|---|---|---|
| 2015/0098206 | A1* | 4/2015 | Pickard | F21K 9/23 362/84 |
| 2016/0109068 | A1* | 4/2016 | Boonekamp | F21V 3/04 362/218 |
| 2017/0082248 | A1* | 3/2017 | West | F21K 9/20 |

* cited by examiner

LED-BASED LINEAR LAMPS AND LIGHTING ARRANGEMENTS

This application claims priority to, and the benefit of, U.S. Provisional Patent Application 62/482,516, filed Apr. 6, 2017, the contents of which are hereby incorporated by reference in their entirety for any and all purposes as if fully set forth herein

FIELD OF THE INVENTION

This disclosure relates to LED-based linear lamps and lighting arrangements. In particular, although not exclusively, embodiments of the invention concern LED-based linear lamps and lighting arrangements including remote photoluminescence wavelength conversion.

BACKGROUND

A common lamp that has achieved great commercial success is the linear fluorescent tube lamp which is an elongated lamp with an isotropic light emission along the length of the lamp. Fluorescent tube lamps are commonly used in office, commercial, industrial and domestic applications and are available in standard sizes such as T5, T8, and T12 lamps.

A lighting arrangement that is commonly used in office and commercial applications is a ceiling-recess or troffer that is mounted within a modular suspended (dropped) ceiling. Other, linear lighting arrangements include suspended linear arrangements that can be direct only (downward light emitting) or direct/indirect (lighting both the workspace in a downward direction and the ceiling in an upward direction for indirect lighting. Surface mount linear fixtures, often called wrap-around lights or wrap lights, are used in office, industrial and domestic spaces. These are typically mounted directly to the surface of the ceiling or a wall. Task lighting and under-cabinet fixtures also commonly use linear lamps as the light source.

FIG. 1 shows an example of a traditional troffer 10 that is used to house fluorescent tube lamps in a modular suspended (dropped) ceiling. The interior of the troffer body 12 includes lamp holders (connectors) on both lateral ends of the arrangement to receive linear fluorescent tubes 14. To achieve desired lighting performance, most troffers are configured to receive several fluorescent tubes, since a single conventional tube by itself cannot usually generate enough light for typical applications. To maximize light emission, the interior surface of the troffer body 12 is light reflective. The troffer can include a removable panel 16 to allow for insertion and replacement of the fluorescent tubes 14. In addition, the panel 16 also provides a location to include a diffuser within the lighting arrangement to improve the uniformity of emission of the arrangement and to reduce glare from the fluorescent tubes.

While traditional fluorescent-tube-based troffers, suspended linear, wrap-around lights and under-cabinet lighting arrangements are very common and exist in almost every commercial and office building, there are disadvantages with such lighting configurations; namely, their non-uniform emission characteristics and the appearance of glare from the fluorescent tubes.

In recent years, white light emitting LEDs ("white LEDs") have become increasingly popular and are now more commonly used to replace conventional fluorescent, compact fluorescent and incandescent light sources. White LEDs generally include one or more photoluminescence materials (typically inorganic phosphor materials), which absorb a portion of the radiation emitted by the LED and re-emit light of a different color (wavelength). The phosphor material may be provided as a layer on, or incorporated within a wavelength converting component that is located remotely from the LED. The latter arrangements are commonly referred to as "remote phosphor" arrangements. As is known, LED-based linear lamps can comprise a linear array of discrete white LEDs or a remote phosphor arrangement comprising a linear array of blue LEDs with a linear remote wavelength converting component overlaying the LEDs. While such LED-based linear lamps provide many benefits over traditional fluorescent lamps, such as improved efficiency and longer life expectancy, they typically possess a substantially Lambertian emission characteristic which can result in pronounced hot spots associated with each LED-based linear lamp. Moreover, in the case of lamps comprising a linear array of discrete white LEDs, these can exhibit pronounced hot spots associated with each of the discrete white LEDs. Such emission characteristics and hot spots are particularly undesirable in troffer applications.

The present invention arose in an endeavor to provide LED-based linear lamps that in troffer-type applications, at least in part, improve the uniformity of emission and reduce the appearance of hot spots.

SUMMARY OF THE INVENTION

Embodiments of the invention pertain to linear lamps that utilize an array of solid-state light emitting devices, typically LEDs (Light Emitting Diodes), in combination with an elongated optical component to generate a desired emission characteristic and to reduce the appearance of hot spots associated with the LEDs. The LED-based linear lamps of the invention at least in part overcome the problems associated with conventional fluorescent lamp.

In some embodiments, the elongated optical component can comprise a remote phosphor arrangement and also functions as a wavelength converting component that includes one or more photoluminescence materials, typically phosphors, to convert light generated by the LEDs into white light. It will be appreciated that in such remote phosphor embodiments the elongated component has a dual function of generating the required color of light and the desired emission characteristic.

According to one embodiment, an elongated optical component having a direction of elongation, comprises: a light transmissive core and a wavelength converting portion disposed on an exterior surface of the light transmissive core, wherein the wavelength converting portion comprises a photoluminescence material, and wherein the wavelength converting portion has a cross-section comprising an apex. The provision of a wavelength converting portion having a cross-section including an apex results in directed shaping of the light emission pattern that is radiated from the component resulting in increased light emission to the sides of the component whilst simultaneously reducing light emission in directions orthogonal thereto. A linear lamp based on such a component finds particular application in lighting arrangements, such as troffers, which require a uniform wide area emission of light to fill large area reflectors of the troffer body. The light transmissive core and wavelength converting portion can define a cross-section that is generally triangular-shaped. In some embodiments, the light transmissive core has a cross-section that is generally triangular in shape and the wavelength converting portion has a cross-section that is generally v-shaped.

At least one of the wavelength converting portion or the light transmissive core can comprise a cross-section having edges that are generally linear, convex or concave forms. For example, where the component core is generally triangular-shaped, the outer surface of the component can comprise outer light emitting surfaces that are generally flat, convex or concave.

The light transmissive core can comprise a channel extending into the light transmissive core (i.e. extending therein), to enable the component to be mounted over an array of LEDs.

For ease of fabrication, each of the light transmissive core and wavelength converting portion can have a consistent (constant) cross-section along the entire length of the component in the direction of elongation. Alternatively, the light transmissive core and wavelength converting portion can define consistent exterior dimensions along the entire length of the component in the direction of elongation. In other embodiments, at least one of the light transmissive core and wavelength converting portion does not have a consistent cross-section along the entire length of the component in the direction of elongation.

For ease of fabrication, the light transmissive core and wavelength converting portion can be integrally formed as a unitary component. In another embodiment, the component is formed as a unitary component by co-extruding the light transmissive core and wavelength converting portion. Alternatively, the component may be formed by injection molding. Some of the advantages associated with integrally forming the wavelength converting component as a unitary component include ease of manufacture, improved robustness and reliability of the component, reduced costs of manufacture, and speed of manufacture. The photoluminescence material(s), which can typically comprise an inorganic phosphor material, can be incorporated into and homogeneously distributed throughout the wavelength converting region. Alternatively and/or in addition, the photoluminescence material can be provided as a layer on a surface of the light transmissive core.

Other embodiments of the invention pertain to LED-based lamps that utilize the optical component of the invention. According to an embodiment, an LED-based lamp comprises: a linear array of LEDs operable to generate excitation light and an elongated optical component having a direction of elongation, comprising: a light transmissive core and a wavelength converting portion comprising a photoluminescence material, wherein the wavelength converting portion is disposed on an exterior surface of the light transmissive core, and wherein the optical component is mountable over the linear array of LEDs. Typically, a majority, if not all, light emitted from the lamp passes through the wavelength converting portion. In some embodiments, the light transmissive core and wavelength converting portion of the component can comprise a flexible silicone material. This can result in a component that is flexible. Combining such a flexible component with a flexible circuit board results in a lamp that is flexible and can be conformed to non-planar surfaces.

In some embodiments, the optical component is configured such that the lamp generates between about 75% and about 95%, preferably about 90%, of the total emitted light over an angle greater than about ±30° to a line of symmetry of the component. The optical component can be configured such that the lamp generates about 40% of the total emitted light over an angle between about ±55° and about ±90° to the line of symmetry of the component. The optical component can be configured such that the lamp generates about 10% of the total emitted light over an angle between about ±90° and ±55° to the line of symmetry of the component.

Other embodiments of the invention pertain to lighting arrangements that utilize the LED-based lamps of the invention. According to an embodiment of the invention, a lighting arrangement comprises: a housing having a light reflective interior surface and at least one LED-based lamp as described above that is located within the housing. A particular advantage of lighting arrangements utilizing lamps in accordance with embodiments of the invention is that due to the enhanced side emission characteristic of the lamps this provides a substantial improvement in emission uniformity from the entire arrangement. A further advantage is that by tailoring the side emission characteristic this enables lighting arrangements to be constructed requiring fewer LED-based linear lamps and which have a shallower profile (i.e. shallower housing) as compared with the known arrangements. For example, it is possible to construct a two foot by two foot troffer using only two LED-based linear lamps with an overall thickness of about two inches.

Whilst the present invention arose in relation to linear lamps that utilize an optical component to generate white light, the elongated optical component of the invention also finds utility in applications that use white LEDs. In such applications the one or more photoluminescence materials of the wavelength converting region is replaced with a light scattering material. According to such an embodiment, an elongated light scattering component having a direction of elongation, comprises: a light transmissive core and a light scattering portion disposed on an exterior surface of the light transmissive core, wherein the light scattering portion comprises a light scattering material, and wherein the light scattering portion has a cross-section comprising an apex.

The light scattering material, which is typically in the form of light scattering particles, is preferably incorporated into and homogeneously distributed throughout the light scattering region of the component. Alternatively and/or in addition, the light scattering material can be provided as a layer on a surface of the light scattering portion. The light scattering material can comprise: zinc oxide, titanium dioxide, barium sulfate, magnesium oxide, silicon dioxide, aluminum oxide, zirconium dioxide or mixtures thereof.

For ease of fabrication, the light transmissive core and/or light scattering portion can extend along the entire length of the component in the direction of elongation. Each of the light transmissive core and/or light scattering portion can have a consistent cross-section along the entire length of the component in the direction of elongation. The light transmissive core and/or light scattering portion can define consistent exterior dimensions along the entire length of the component in the direction of elongation. In other embodiments, at least one of the light transmissive core and/or light scattering portion does not have a consistent cross-section along the entire length of the component in the direction of elongation.

Other embodiments of the invention pertain to LED-based lamps that utilize the light scattering component of the invention. According to one embodiment, an LED-based lamp comprising: a linear array of LEDs operable to generate white light and an elongated light scattering component in accordance with the invention.

Advantageously, the light scattering component is configured such that the lamp generates between about 75% and about 95% of the total emitted light over an angle greater than about ±30° to the line of symmetry of the component. Preferably, the component is configured such that the lamp generates about 90% of the total emitted light over angle greater than about ±30° to the line of symmetry of the component. Additionally, the component is configured such that the lamp generates about 40% of the total emitted light over an angle between about ±55° and about ±90° to the line of symmetry of the component. The component can be configured such that the lamp generates about 10% of the total emitted light over an angle between about ±90° and ±55° to the line of symmetry of the component. The component can configured such that the lamp generates about 10% of the total emitted light over an angle between about ±90° and ±55° to the line of symmetry of the component.

Other embodiments of the invention pertain to lighting arrangements that utilize the LED-based lamps of the invention. According to an embodiment of the invention a lighting arrangement comprises: a housing having a light reflective interior surface and at least one LED-based lamp utilizing a light scattering component as described above that is located within the housing. A particular advantage of lighting arrangements utilizing lamps in accordance with embodiments of the invention is that due to the enhanced side emission characteristic of the lamps this provides a substantial improvement in emission uniformity from the entire arrangement. A further advantage is that by tailoring the side emission characteristic this enables lighting arrangements to be constructed having a shallower profile (i.e. shallower housing) as compared with the known arrangements.

DESCRIPTION OF THE DRAWINGS

In order that the present invention is better understood, LED-based lamps and lighting arrangements in accordance with the invention will now be described, by way of example only, with reference to the accompanying drawings in which like reference numerals are used to denote like parts, and in which.

DETAILED DESCRIPTION OF THE INVENTION

Figure 1:
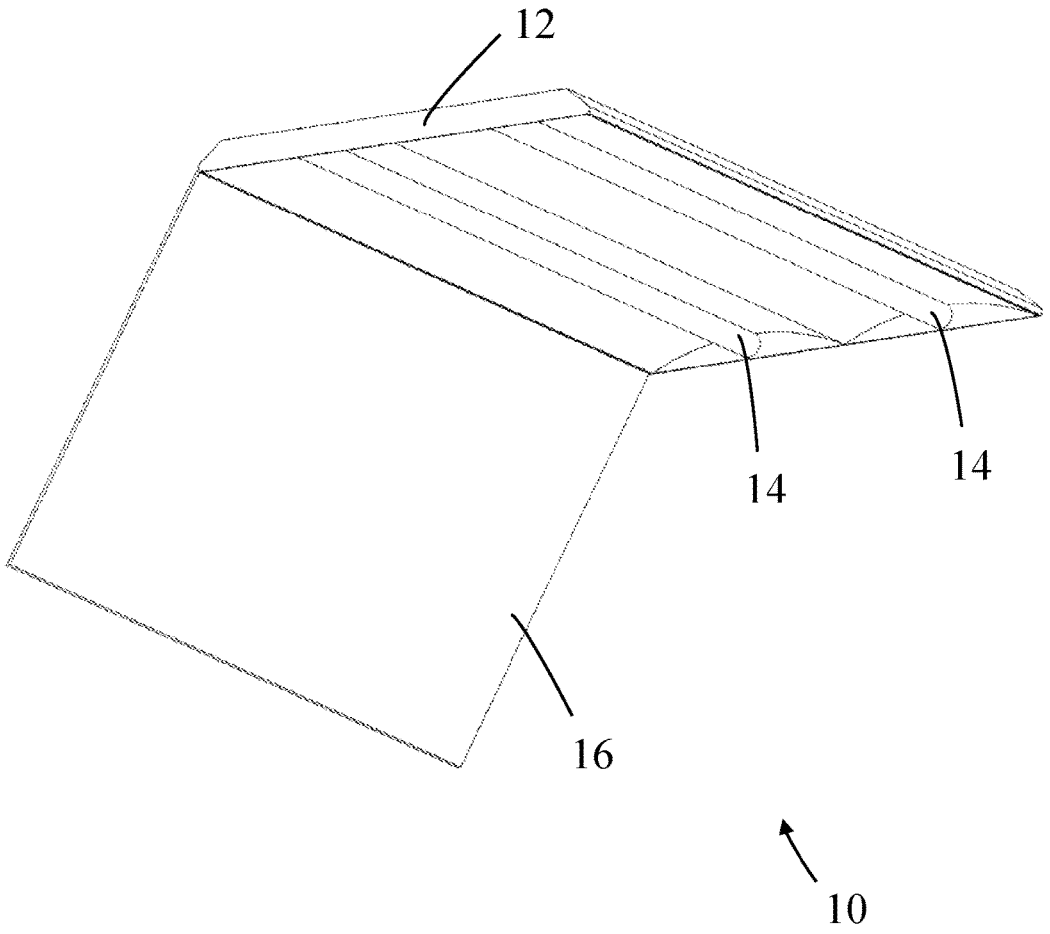
(PRIOR ART) FIG. 1
FIG. 1 shows an example of a traditional ceiling-mountable troffer.

Embodiments of the present invention will now be described in detail with reference to the drawings, which are provided as illustrative examples of the invention so as to enable those skilled in the art to practice the invention. Notably, the figures and examples below are not meant to limit the scope of the present invention to a single embodiment, but other embodiments are possible by way of interchange of some or all of the described or illustrated elements. Moreover, where certain elements of the present invention can be partially or fully implemented using known components, only those portions of such known components that are necessary for an understanding of the present invention will be described, and detailed descriptions of other portions of such known components will be omitted so as not to obscure the invention. In the present specification, an embodiment showing a singular component should not be considered limiting; rather, the invention is intended to encompass other embodiments including a plurality of the same component, and vice-versa, unless explicitly stated otherwise herein. Moreover, applicants do not intend for any term in the specification or claims to be ascribed an uncommon or special meaning unless explicitly set forth as such. Further, the present invention encompasses present and future known equivalents to the known components referred to herein by way of illustration. Throughout this specification like reference numerals are used to denote like features.

As previously discussed, conventional LED-based linear lamps can comprise a linear array of discrete white LEDs or a linear array of blue LED with a linear remote wavelength converting component overlaying the LEDs. The problem with the conventional LED-based linear lamps is that they emit light having substantially Lambertian emission characteristics, which when used in troffer applications can result in pronounced hotspots corresponding to the location of the LEDs and/or LED-based linear lamps. This means that such linear lamps typically cannot produce even distributions of light over wide angles, and that light at specific locations from such lamps (e.g., at locations directly adjacent to the LEDs) are much brighter than light from other portions of the lamp that are not directly beneath the LEDs. To increase the light emission uniformity in such troffer lighting arrangements, it is known to include a diffuser over the opening of the troffer body. While use of a diffuser can improve the uniformity of emission and reduce hot spots and glare, the diffuser can significantly reduce the overall efficiency of the lighting arrangement.

Figure 2A:
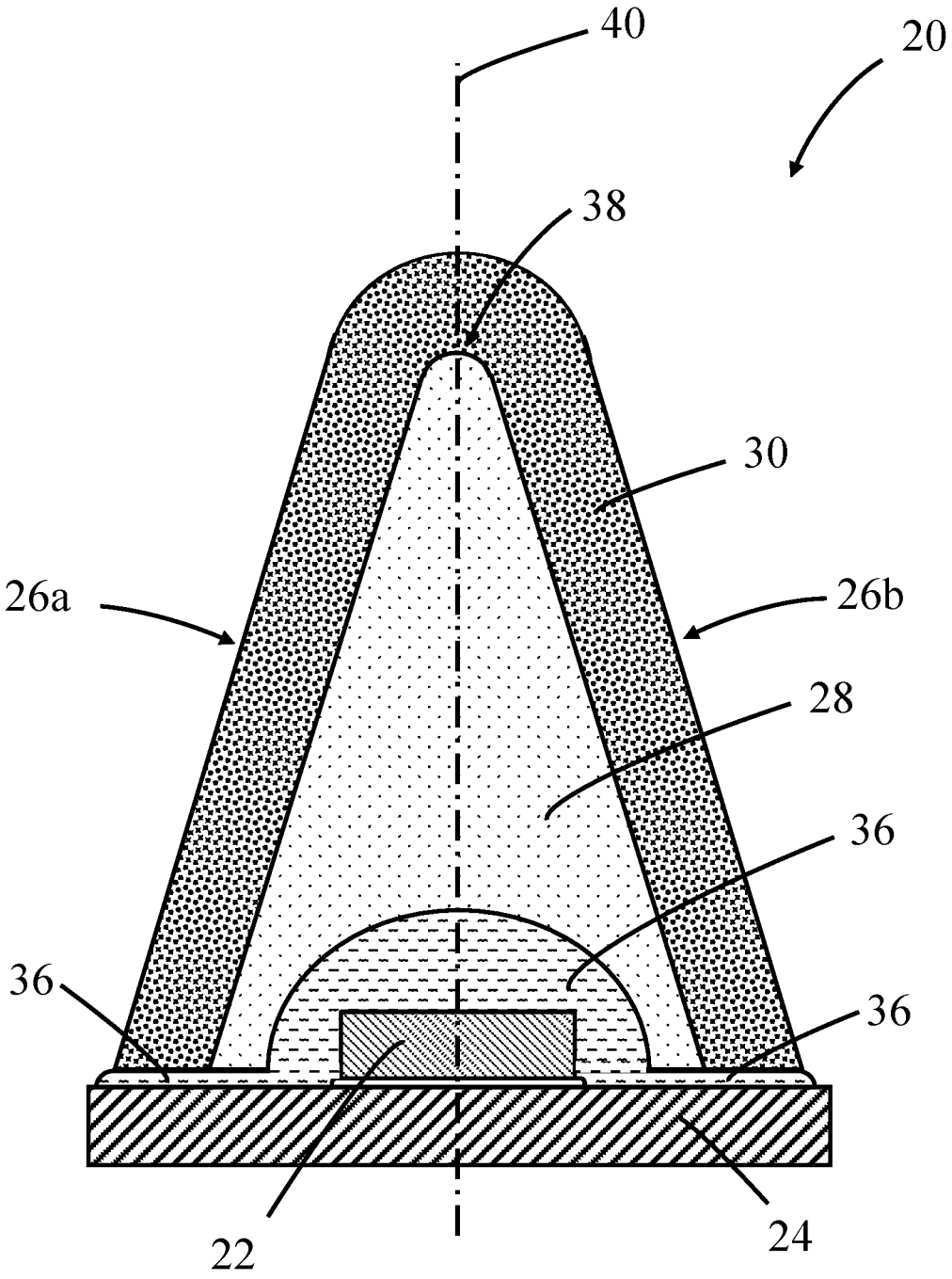
FIGS. 2A and 2B respectively show schematic end and exploded perspective views of an LED-based lamp in accordance with an embodiment of the invention.
Figure 2B:
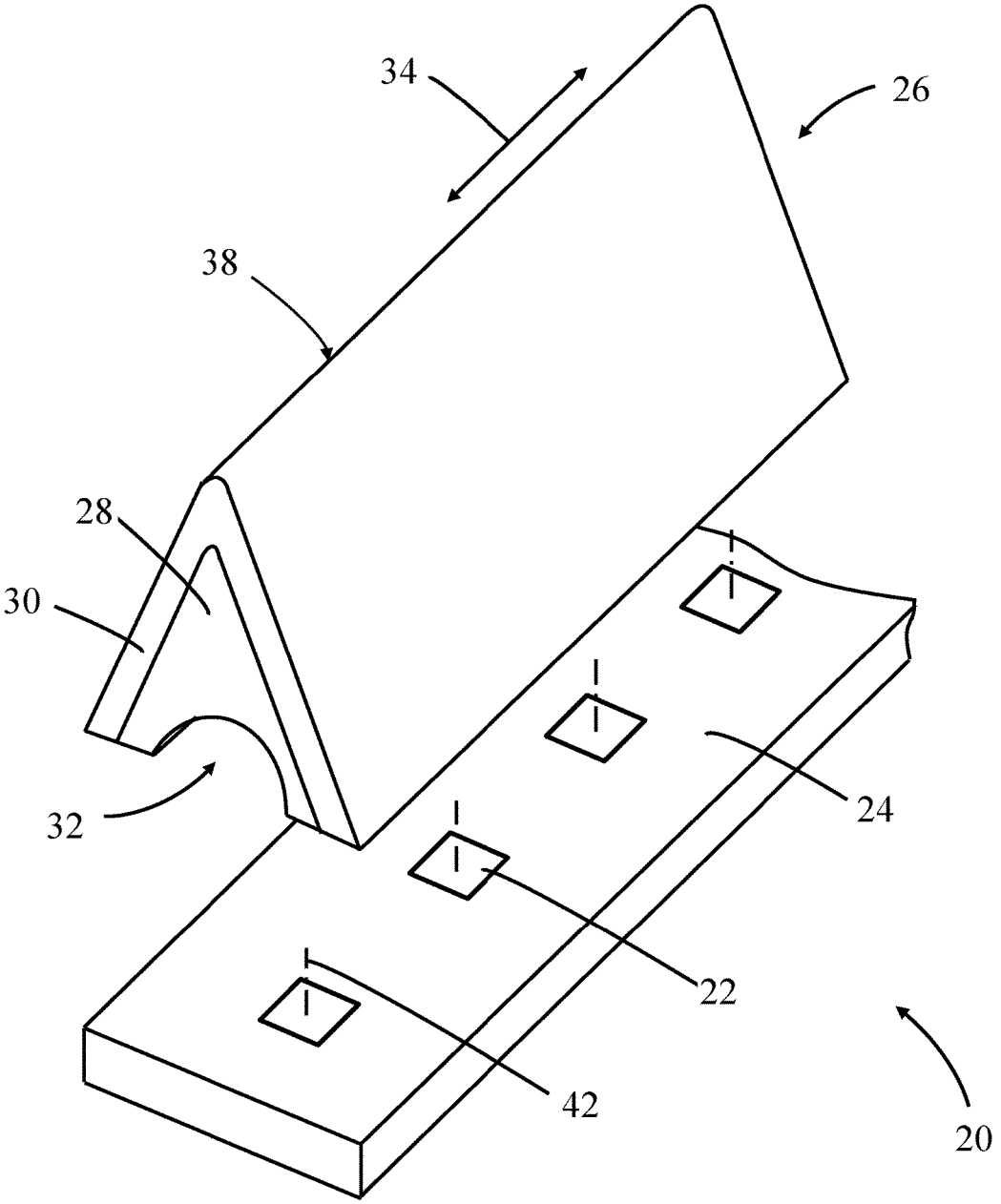

The present disclosure provides an improved approach to implement LED-based linear lamps that address these and other problems with the conventional solutions. FIGS. 2A and 2B illustrate an embodiment of an elongated LED-based lamp 20 according to some embodiments of the invention. The LED-based lamp 20 comprises a linear array of LEDs 22 that are arranged on a substrate (e.g., a circuit board) 24 and a solid elongated optical component 26.

Figure 3:
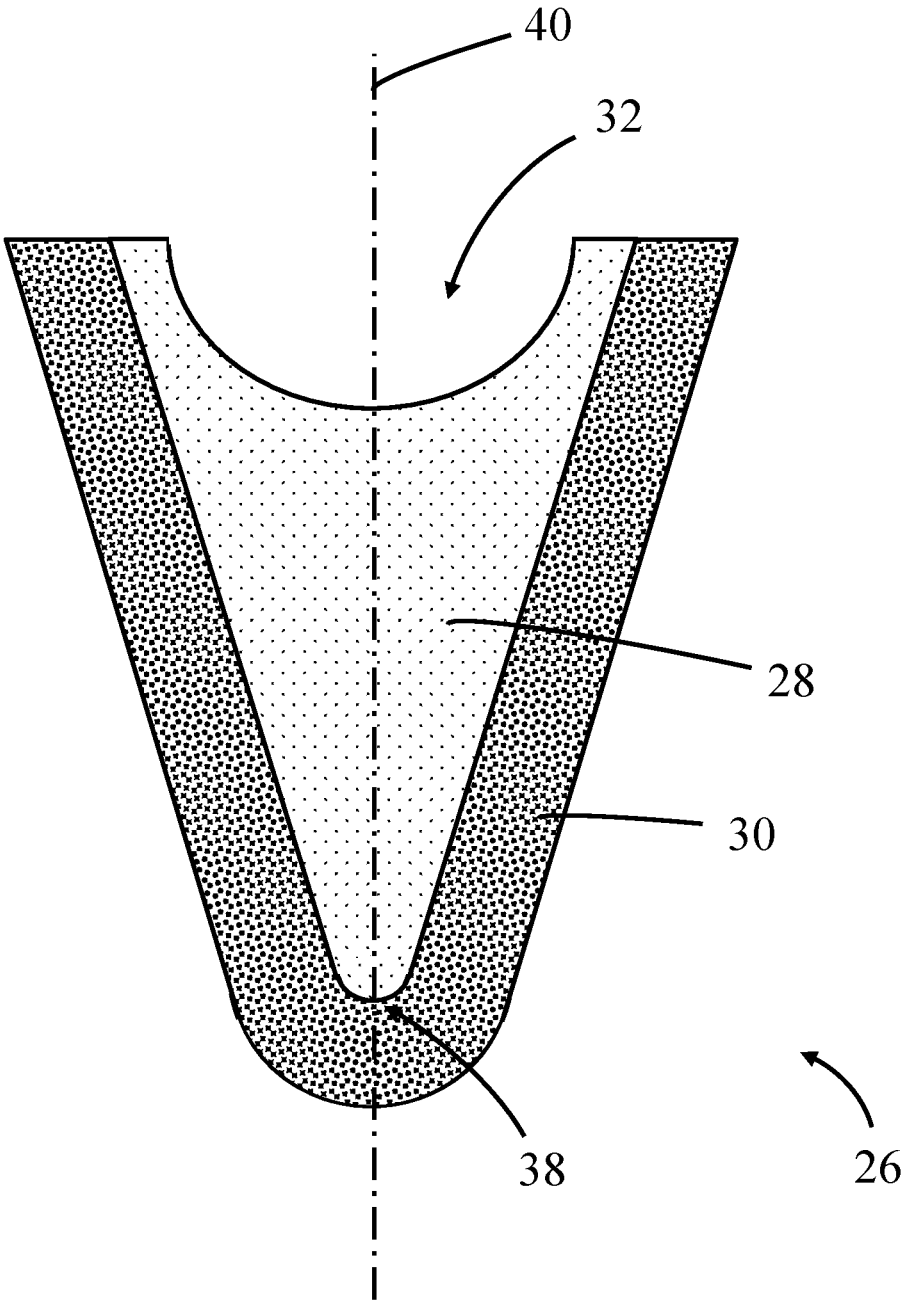
FIG. 3 is an end view of an elongated optical component of the LED-based lamp of FIGS. 2A and 2B.

As shown in FIG. 3, the optical component 26 comprises a solid light transmissive core 28 and a photoluminescence wavelength converting portion 30. The light transmissive core 28 can comprise a cross-section that is generally triangular-shaped and the wavelength converting portion 30 is generally "v-shaped" in form and comprises a substantially uniform thickness layer on two of the faces of the core. It will be appreciated that the combination of the light transmissive core 28 and wavelength converting portion 30 define an overall component cross-section that is generally "triangular-shaped". The provision of a component 26 and/or a wavelength converting portion 30 having a cross-section comprising an apex 38, results in directed shaping of the light emission pattern that is radiated from the component 26. Since the component emits light from both faces 26*a*, 26*b* of the wavelength converting portion 30 (i.e. in directions that are generally orthogonal to the direction of elongation of the component), while reducing direct emissions of light due to the small size of the apex 38 of the wavelength converting portion, this results in a "flattening" of the emission profile from the component 26, causing a more uniform emission of light over very wide emission angles. This means that a lamp having this component configuration can very efficiently provide greater levels of lighting uniformity, since excessive numbers of LEDs are not required to fill in the gaps between hotspots, as may be required using prior solutions. This also means that both lower costs and greater operating efficiencies can be achieved, since fewer LEDs are required to achieve equivalent lighting performance. As indicated in FIG. 3, the light transmissive core 28 can have a cross-section that comprises an isosceles triangle; that is, it has a line of symmetry 40 passing through the apex 38 of the component/wavelength converting portion. Such an arrangement will result in a symmetrical emission characteristic, that is symmetrical in directions orthogonal to the direction of elongation 34 of the component about the line of symmetry.

The light transmissive core 30 can comprise any light transmissive medium such as for example polycarbonate or silicone material. Preferably, the light transmissive medium comprises a material with an index of refraction which is the same as or substantially matches the index of refraction of the wavelength converting portion. Such an arrangement can eliminate any mismatch in index of refraction between the core and wavelength converting portion and thereby maximize light coupling into the wavelength converting portion.

The solid light transmissive core 28 further comprises a channel 32 that projects into the light transmissive core towards the apex 38 of the component and extends in a direction of elongation 34 of the component. The channel 32 can comprise a generally semi-circular profile that is open on the base of the wavelength converting component. The channel 32 is configured to enable the component 26 to be mounted over the LEDs 22 such that the LEDS are located within the interior of the channel 32. As shown in FIG. 2A, the channel 32 can be filled with a light transmissive medium 36, such as for example a silicone, polycarbonate, or epoxy, when mounting the component 26 on the substrate 24. The inclusion of the light transmissive medium 36 eliminates the air-interface between the LEDs 22 and light transmissive core 28 thereby maximizing coupling of light from the LEDs into the component.

The wavelength converting portion 30 includes one or more blue light excitable photoluminescence materials (e.g., phosphor materials). The wavelength converting portion 30 can be formed of and/or include any suitable photoluminescence material(s). The photoluminescence material(s) may be included as a layer of material on an exterior surface of the light transmissive core (the exterior surface can be defined as the surface away from the channel). Alternatively, the photoluminescence material(s) may be distributed (e.g., uniformly distributed) within a light transmissive carrier material such as a silicone material. In some embodiments, the photoluminescence materials comprise phosphors. For the purposes of illustration only, the current description may specifically refer to photoluminescence materials embodied as phosphor materials. However, the invention is applicable to any type of photoluminescence material, such as phosphor materials or quantum dots or combinations thereof. A quantum dot is a portion of matter (e.g. semiconductor) whose excitons are confined in all three spatial dimensions that may be excited by radiation energy to emit light of a particular wavelength or range of wavelengths.

The one or more phosphor materials can include an inorganic or organic phosphor such as for example silicate-based phosphor of a general composition $A_3Si(O,D)_5$ or $A_2Si(O,D)_4$ in which Si is silicon, O is oxygen, A includes strontium (Sr), barium (Ba), magnesium (Mg) or calcium (Ca) and D includes chlorine (Cl), fluorine (F), nitrogen (N) or sulfur (S). Examples of silicate-based phosphors are disclosed in U.S. Pat. No. 7,575,697 B2 "Silicate-based green phosphors", U.S. Pat. No. 7,601,276 B2 "Two phase silicate-based yellow phosphors", U.S. Pat. No. 7,655,156 B2 "Silicate-based orange phosphors" and U.S. Pat. No. 7,311,858 B2 "Silicate-based yellow green phosphors". The phosphor can also include an aluminate-based material such as is taught in U.S. Pat. No. 7,541,728 B2 "Novel aluminate-based green phosphors" and U.S. Pat. No. 7,390,437 B2 "Aluminate-based blue phosphors", an aluminum-silicate phosphor as taught in U.S. Pat. No. 7,648,650 B2 "Aluminum-silicate orange-red phosphor" or a nitride-based red phosphor material such as is taught in U.S. Pat. No. 8,274,215 B2 "Nitride-based red-emitting phosphors". It will be appreciated that the phosphor material is not limited to the examples described and can include any phosphor material including nitride and/or sulfate phosphor materials, oxy-nitrides and oxy-sulfate phosphors or garnet materials (YAG).

Quantum dots can comprise different materials; for example, cadmium selenide (CdSe). The color of light generated by a quantum dot is enabled by the quantum confinement effect associated with the nano-crystal structure of the quantum dots. The energy level of each quantum dot relates directly to the size of the quantum dot. For example, the larger quantum dots, such as red quantum dots, can absorb and emit photons having a relatively lower energy (i.e. a relatively longer wavelength). On the other hand, orange quantum dots, which are smaller in size can absorb and emit photons of a relatively higher energy (shorter wavelength). Additionally, embodiments are envisioned that use cadmium free quantum dots and rare earth (RE) doped oxide colloidal phosphor nano-particles, in order to avoid the toxicity of the cadmium in the quantum dots. Examples of suitable quantum dots include: CdZnSeS (cadmium zinc selenium sulfide), $Cd_xZn_{1-x}Se$ (cadmium zinc selenide), $CdSe_xS_{1-x}$ (cadmim selenium sulfide), CdTe (cadmium telluride), $CdTe_xS_{1-x}$ (cadmium tellurium sulfide), InP (indium phosphide), $In_xGa_{1-x}P$ (indium gallium phosphide), InAs (indium arsenide), $CuInS_2$ (copper indium sulfide), $CuInSe_2$ (copper indium selenide), $CuInS_xSe_{2-x}$ (copper indium sulfur selenide), Cu $In_xGa_{1-x}S_2$ (copper indium gallium sulfide), $CuIn_xGa_{1-x}Se_2$ (copper indium gallium selenide), $CuIn_xAl_{1-x}Se_2$ (copper indium aluminum selenide), $CuGaS_2$ (copper gallium sulfide) and $CuInS_{2x}ZnS_{1-x}$ (copper indium selenium zinc selenide). The quantum dots material can comprise core/shell nano-crystals containing different materials in an onion-like structure. For example, the above described exemplary materials can be used as the core materials for the core/shell nano-crystals. The optical properties of the core nano-crystals in one material can be altered by growing an epitaxial-type shell of another material. Depending on the requirements, the core/shell nano-crystals can have a single shell or multiple shells. The shell materials can be chosen based on the band gap engineering. For example, the shell materials can have a band gap larger than the core materials so that the shell of the nano-crystals can separate the surface of the optically active core from its surrounding medium. In the case of the Camden-based quantum dots, e.g. CdSe quantum dots, the core/shell quantum dots can be synthesized using the formula of CdSe/ZnS, CdSe/CdS, CdSe/ZnSe, CdSe/CdS/ZnS, or CdSe/ZnSe/ZnS. Similarly, for $CuInS_2$ quantum dots, the core/shell nanocrystals can be synthesized using the formula of $CuInS_2/ZnS$, $CuInS_2/CdS$, $CuInS_2/CuGaS_2$, $CuInS_2/CuGaS_2/ZnS$ and so on.

For ease of fabrication, the light transmissive core 28 and wavelength converting portion 30 are integrally formed as a unitary component. In a preferred embodiment, the optical component is formed as a unitary component by co-extruding the wavelength converting and light transmissive core of the component. In some embodiments, the optical component 26 comprises polycarbonate though it can comprise other light transmissive materials such as silicone. Alternatively, the component may be formed by injection molding or other manufacturing methods.

In some embodiments, the substrate 24 comprises a MCPCB (Metal Core Printed Circuit Board). In other embodiments, the substrate can comprise a flexible circuit board. As noted above, a plurality of LEDs 22 are mounted on the substrate 24. For the purposes of illustration, the term "LED" is used herein to refer to any type of solid-state light emitter and is not limited solely to light emitting diodes. The LEDs 22 can be configured as an array, e.g., in a linear array and/or oriented such that their principal emission axis 42 is parallel with the projection axis of the lamp. The wavelength converting component 26 is mountable over the linear array of LEDs 22 such that the apex 38 of the component/wavelength converting portion overlays the principal emission axis 42 of the LEDs 22.

Typically, the light transmissive core 28 and the wavelength converting portion 30 have a consistent (constant) cross-section along the entire length of the component in the direction of elongation 34. In other embodiments, at least one of the light transmissive core 28 and wavelength converting portion 30 does not have a consistent cross-section along the entire length of the component in the direction of elongation. This approach may be taken, for example, to change the relative dimensions of these portions at various points along the component 26, e.g., at the locations of the LEDs 22.

In some embodiments, the light transmissive core 28 and wavelength converting portion 30 define consistent exterior dimensions along the entire length of the component in the direction of elongation. This is regardless of whether or not the individual dimensions of the light transmissive core 28 and the wavelength converting portion 30 differ from one part of the component to another part of the component. For example, the exterior shape of the component 26 can stay the same through its entire length, but the light transmissive core 28 and wavelength converting portion 30 can change shape along the length of the component.

In some embodiments, the light transmissive core 28 and wavelength converting portion 30 define a cross-section having a line of symmetry 40 (FIG. 3). Such geometry provides an emission characteristic that is symmetrical about the line of symmetry. In an alternate embodiment, the light transmissive core 28 and wavelength converting portion 30 can define a cross-section that is not symmetrical through the apex of the wavelength converting portion, e.g., to shape light emission that is dominant toward one side or the other of a lamp.

Figure 4:
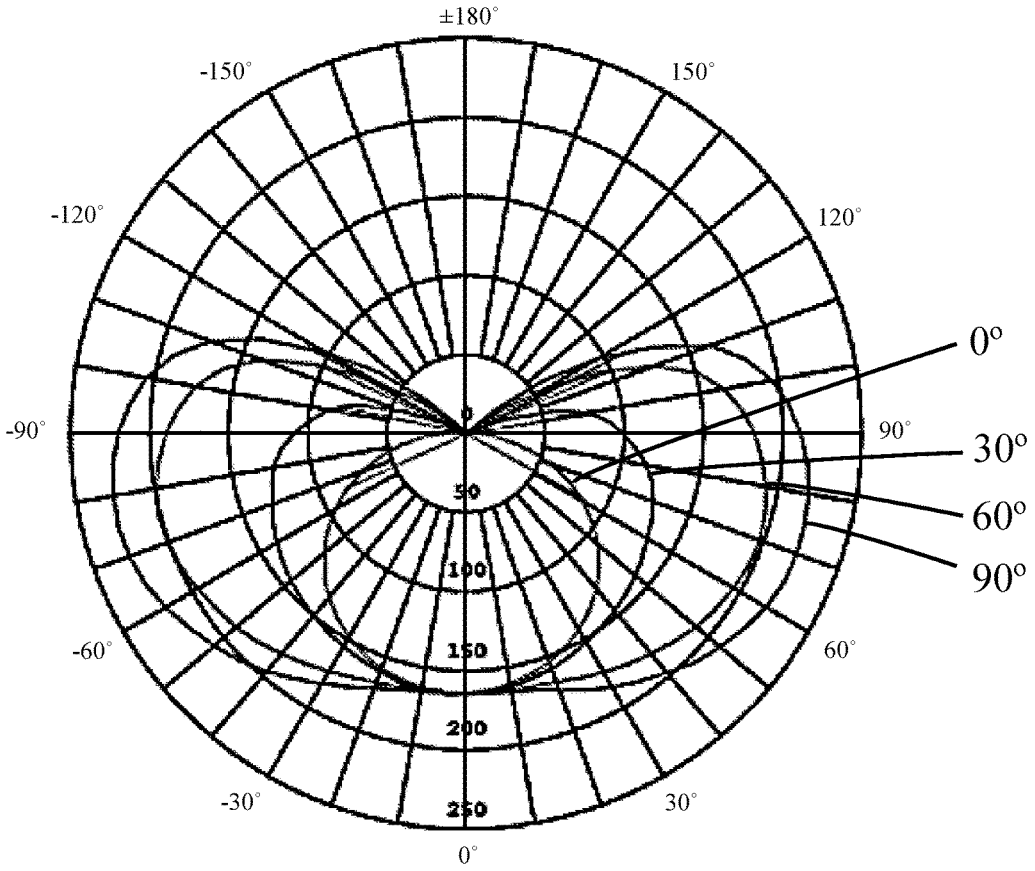
FIG. 4 is the measured emission characteristic of the optical component of FIG. 3 for light emission in directions relative to the direction of elongation of 0°, 30°, 60° and 90° the component.

FIG. 4 illustrates the measured emission characteristic of an LED-based lamp of FIG. 2A for light emission in directions relative to the direction of elongation 34 of the component of 0°, 30°, 60° and 90°. The lamp is configured to generate white light with a nominal CCT (Correlated Color Temperature) of 4000 K and a CRI (Color Rendering Index) of 80. The component is co-extruded with the light transmissive core 28 and wavelength converting portion 30 comprising a flexible silicone material (Shin Etsu SV-48030U). The component is attached to the LED arrays using a silicone adhesive 36 (ShinEtsu X-832-424). The wavelength converting portion comprises a mixture of yellow (550 nm) YAG (NYAG5355 from Intematix Corporation), green (531 nm) YAG (GNYAG3657 from Intematix Corporation) and red (628 nm) nitride (SB628A from Intematix Corporation) phosphors. As can be seen from this figure, the emission characteristic in a direction orthogonal to the direction of elongation is non-Lambertian and has side lobes indicating that a significant proportion of light is being emitted out to the sides of the component. Furthermore, the characteristic labeled 0° shows that the wavelength converting component has an emission characteristic in a direction of elongation of the component that is substantially Lambertian.

Figure 5:
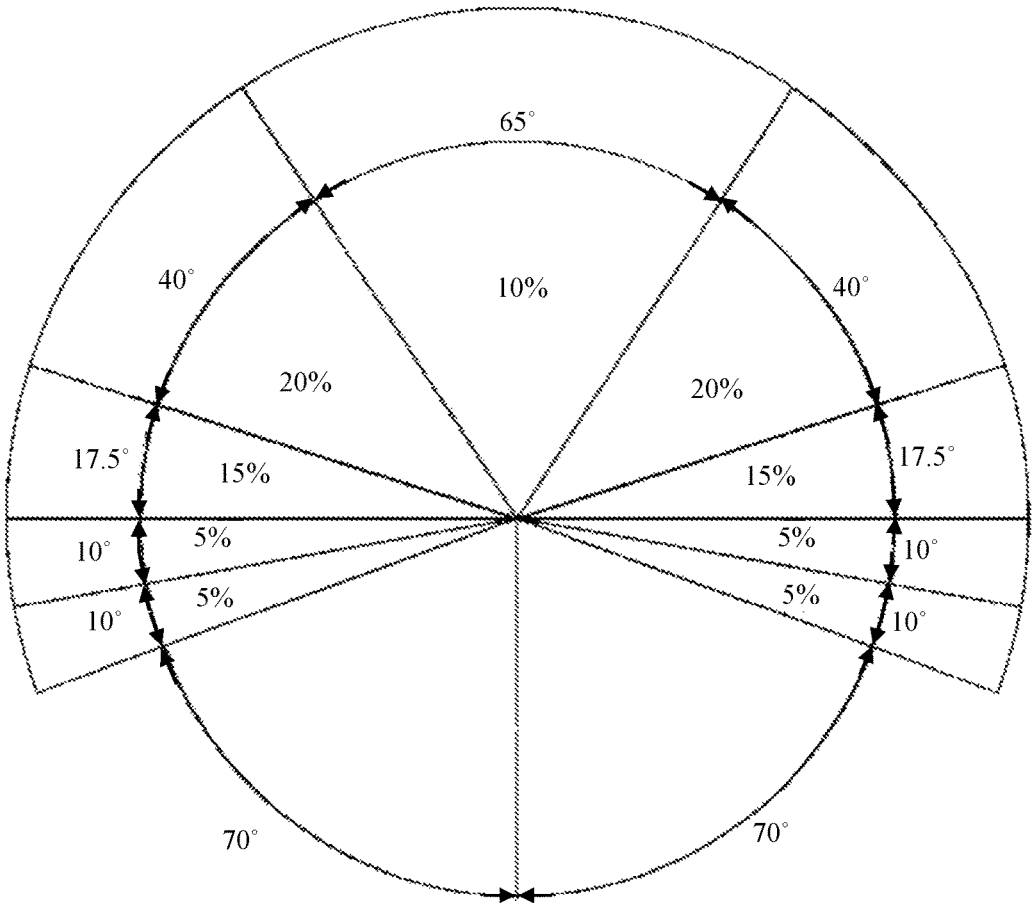
FIG. 5 is a representation of the distribution of total light emission orthogonal (90°) to the direction of elongation of the component for optical components in accordance with the invention.

FIG. 5 is a visual representation of the distribution of total light emission orthogonal) (90°) to the direction of elongation of the component for optical components in accordance with the invention. FIG. 5 indicates that about 10% of the total light emission is within about ±32.5° in other words about 90% of light is emitted at angles of greater than about 32.5°. The figure further indicates that between about 75% and about 95%, preferably about 90% of the totally emitted light over an angle greater than about ±30° to the line of symmetry 40 of the component. In some embodiments, the optical component can be configured such that it generates about 40% of the totally emitted light over an angle between about ±55° and about ±90° to the line of symmetry of the component. The component can be configured such that it generates about 10% of the totally emitted light over an angle between about ±90° and ±55° to the line of symmetry of the component.

Figure 6:
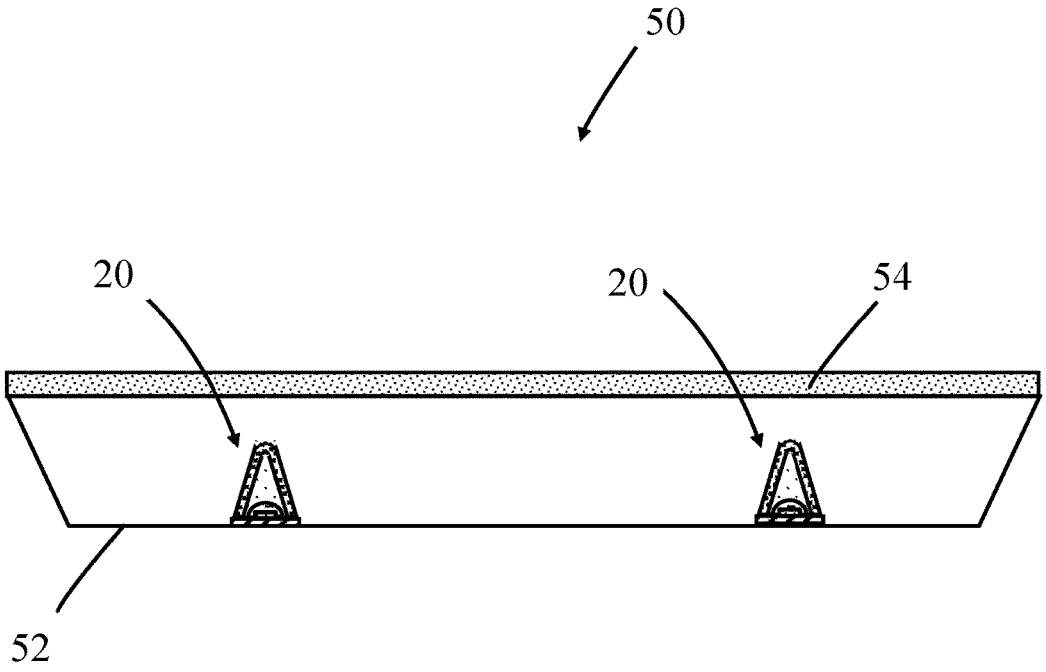
FIG. 6 is a lighting arrangement, troffer, in accordance with an embodiment of the invention.

Other embodiments of the invention pertain to lighting arrangements that utilize the LED-based lamps of the invention. FIG. 6 illustrates a lighting arrangement, troffer, 50 in accordance with an embodiment of the invention that utilizes the LED-based lamps 20 of the invention. The lighting arrangement comprises a troffer body 52 that houses a plurality of LED-based lamps 20 as described above. To maximize light emission from the arrangement, the troffer body 52 comprises an inner surface that is highly light reflective (i.e. has a reflectance of 95 or greater). To reduce "hot spots" or glare, the lighting arrangement can further comprise a light diffusive cover 54 overlaying the troffer body opening. The inventor has discovered that it possible to implement a two foot by two foot troffer using only two LED-based lamps according to the invention while still achieving a virtually uniform emission characteristic. A particular advantage of lighting arrangements utilizing lamps in accordance with embodiments of the invention is that due to the enhanced side emission characteristic of the lamps this provides a substantial improvement in emission uniformity from the entire arrangement. A further advantage is that by tailoring the side emission characteristic this enables lighting arrangements to be constructed having a shallower profile (i.e. shallower housing) as compared with the known arrangements. For example, troffers can be implemented having a troffer body depth of two inches or smaller.

White LED Lighting Arrangements and Light Scattering Component

Figure 7:
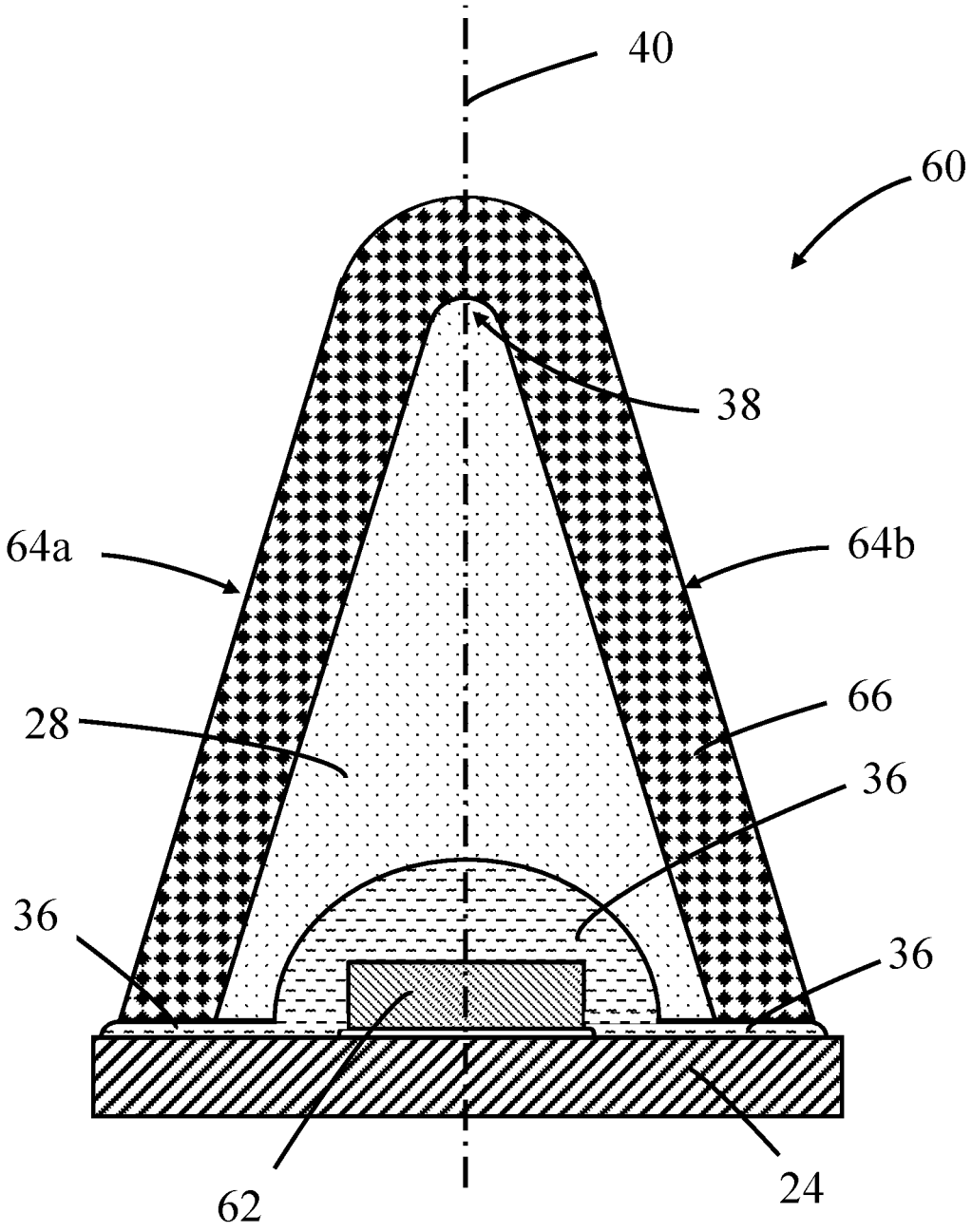
FIG. 7 is a schematic end view of an LED-based lamp in accordance with an embodiment of the invention that utilizes white LEDs.
Figure 8:
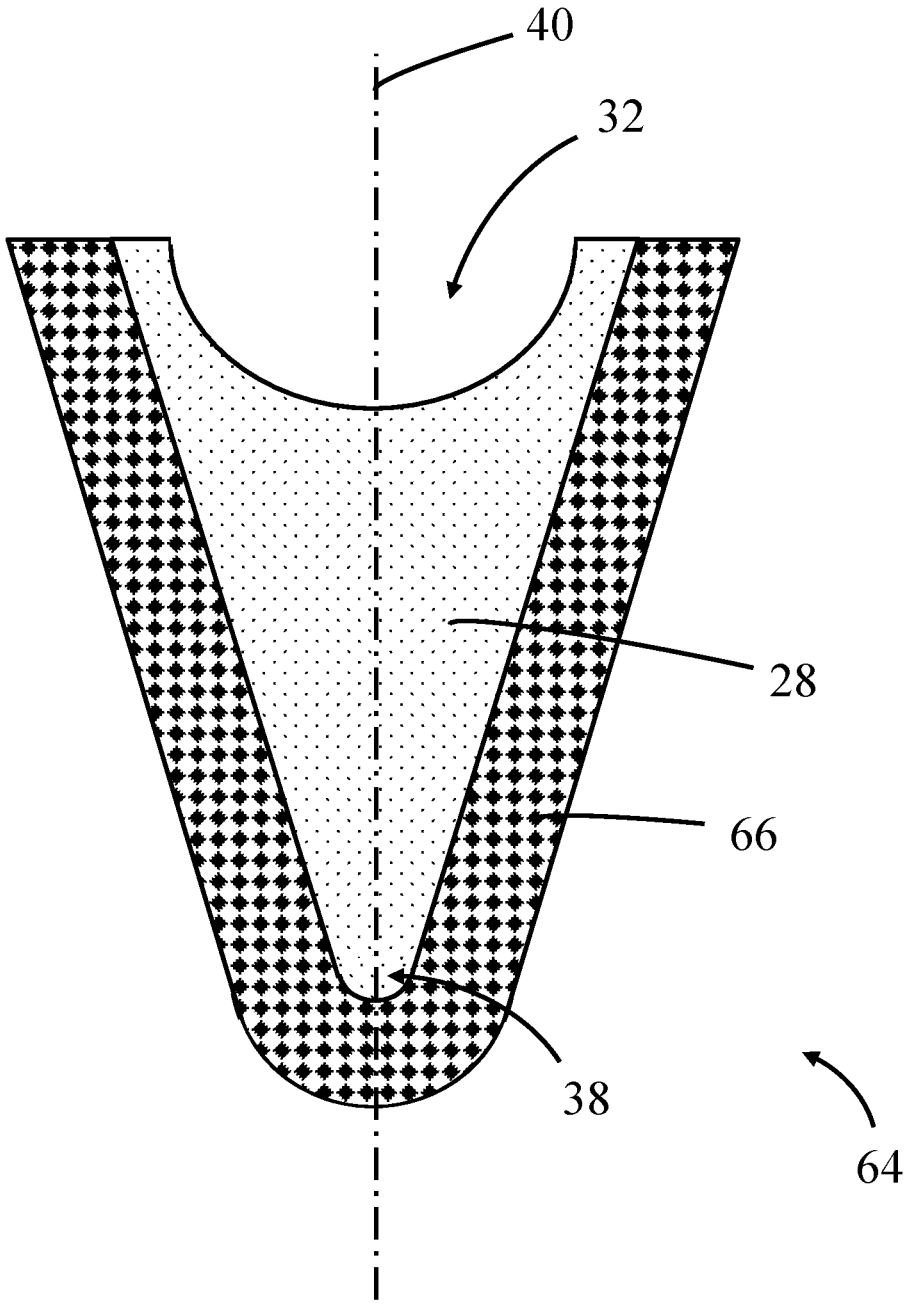
FIG. 8 is an end view of an elongated optical component of the LED-based lamp of FIG. 7.

Whilst the foregoing embodiments concerned linear lamps and lighting arrangements that utilize a photoluminescence material to convert LED generated light, typically blue, to white light, embodiments of the present invention also finds utility in applications that use white LEDs. In such applications, the elongated optical component comprises a light scattering material in place of the one or more photoluminescence materials of the wavelength converting region. An example of an LED-based lamp 60 based on white LEDs 62 is shown in FIG. 7 and FIG. 8 is an end view of an elongated optical component of the LED-based lamp of FIG. 7. As shown in FIG. 8 the elongated light scattering component 64 comprises a light transmissive core 28 and a light scattering portion 66. The component 64 emits light from both faces 64*a*, 64*b* of the light scattering portion 66. The light scattering material, which is typically in the form of particles, is preferably incorporated into and homogeneously distributed throughout the light scattering portion of the component 64. Alternatively and/or in addition the light scattering material can be provided as a layer on a surface of the light transmissive core 28. The light scattering material can comprise: zinc oxide, titanium dioxide, barium sulfate, magnesium oxide, silicon dioxide, aluminum oxide, zirconium dioxide or mixtures thereof.

Although the present invention has been particularly described with reference to certain embodiments thereof, it should be readily apparent to those of ordinary skill in the art that changes and modifications in the form and details may be made without departing from the spirit and scope of the invention.

For example, whilst embodiments of the invention have been described in relation to troffer-based lighting arrangements, the wavelength converting component and LED-based lamps utilizing such components find utility in other linear lighting arrangements including, but not limited to, suspended linear lighting arrangements, surface mountable linear lighting arrangements such as wraparound lights or wrap lights, and task lighting arrangements.

What is claimed is:

1. An elongated optical component having a direction of elongation, comprising:

a light transmissive core and a wavelength converting portion disposed on an exterior surface of the light transmissive core, wherein the wavelength converting portion comprises a photoluminescence material, and wherein the wavelength converting portion has a cross-section comprising an apex.

2. The component of claim 1, wherein the light transmissive core and wavelength converting portion define a cross-section that is generally triangular-shaped.

3. The component of claim 1, wherein the wavelength converting portion has a cross-section that is generally v-shaped.

4. The component of claim 1, wherein the light transmissive core comprises a channel extending therein.

5. The component of claim 1, wherein the light transmissive core and wavelength converting portion comprise a silicone material.

6. The component of claim 1, wherein the photoluminescence material is distributed throughout the wavelength converting portion.

7. The component of claim 1, wherein the component is formed as a unitary component by co-extrusion of the light transmissive core and wavelength converting portion.

8. The component of claim 1, wherein each of the light transmissive core and the wavelength converting portion have a consistent cross-section along the entire length of the component in the direction of elongation.

9. An LED-based lamp comprising: a linear array of LEDs operable to generate excitation light and an elongated optical component according to claim 1, wherein the wavelength converting portion is mountable over the linear array of LEDs such that the wavelength converting portion comprises an apex that overlays the array of LEDs.

10. The lamp of claim 9, wherein the light transmissive core and wavelength converting portion define a cross-section that is generally triangular-shaped.

11. The component of claim 1, wherein the photoluminescence material is provided as a layer on a surface of the light transmissive core.

12. An elongated optical component having a direction of elongation, comprising:

a light transmissive core and a light scattering portion disposed on an exterior surface of the light transmissive core across substantially all of the cross-section of the light transmissive core, wherein the light scattering portion comprises a light scattering material, and wherein the light scattering portion has a cross-section comprising an apex.

13. The component of claim 12, wherein the light transmissive core and wavelength converting portion define a cross-section that is generally triangular-shaped.

14. The component of claim 12, wherein the light transmissive core comprises a channel extending into the light transmissive core.

15. The component of claim 12, wherein the light scattering material is selected from the group consisting of: zinc oxide (ZnO); silicon dioxide ($SiO_2$); titanium dioxide ($TiO_2$); magnesium oxide (MgO); barium sulfate ($BaSO_4$); aluminum oxide ($Al_2O_3$) and combinations thereof.

16. The component of claim 12, wherein the wavelength converting portion has a cross-section that is generally v-shaped.

17. An LED-based lamp comprising: a linear array of LEDs and an elongated optical component according to claim 12, wherein the light scattering portion is mountable over the linear array of LEDs such that the light scattering portion comprises an apex that overlays the array of LEDs.

* * * * *